United States Patent [19]

Edelstein

[11] 3,958,627

[45] May 25, 1976

[54] TRANSVERSE VARIABLE CONDUCTANCE HEAT PIPE

[75] Inventor: Frederick Edelstein, Hauppauge, N.Y.

[73] Assignee: Grumman Aerospace Corporation, Bethpage, N.Y.

[22] Filed: Oct. 15, 1974

[21] Appl. No.: 515,433

[52] U.S. Cl. ..... 165/32; 165/105

[51] Int. Cl.[2] ..... F28D 15/00

[58] Field of Search ..... 165/32, 105

[56] References Cited

UNITED STATES PATENTS

| | | | |
|---|---|---|---|
| 2,499,736 | 3/1950 | Kleen | 165/105 X |
| 3,525,386 | 8/1970 | Grover | 165/32 |
| 3,638,023 | 1/1972 | Cottam et al. | 165/105 X |

*Primary Examiner*—Albert W. Davis, Jr.
*Attorney, Agent, or Firm*—Morgan, Finnegan, Pine, Foley & Lee

[57] ABSTRACT

A novel transverse variable conductance heat pipe is disclosed which is based on the combination of a wicked closed casing having an internal baffle for changing the direction of vapor flow, a vaporizable liquid, a non-condensible gas and a reservoir for the non-condensible gas.

12 Claims, 4 Drawing Figures

TRANSVERSE VARIABLE CONDUCTANCE HEAT PIPE

This invention relates to a novel transverse variable conductance heat pipe which is based on the combination of a wicked closed casing having an internal baffle for changing the direction of vapor flow, a vaporizable liquid, a non-condensible gas and a reservoir for the non-condensible gas.

BACKGROUND OF THE INVENTION

Heat pipes are known which have long heat transport distances that result from having the evaporator surface at one end of the heat pipe and the condenser surface at the opposite end. These heat pipes usually have relatively low heat transport capabilities as there are high viscous liquid pressure losses associated with the arterial liquid flow means. This has resulted in the fabrication of larger structures to handle high heat loads. Also, the prior art variable conductance heat pipes have had limited heat capacity and have been unable to handle high heat loads without burnout. A variable conductance heat pipe is mentioned by Bienert et al, AIAA Progress in Astronautics and Aeronautics: Fundamentals of Spacecraft Thermal Design, Vol. 29., Lucas, MIT Press Cambridge, Mass (1972) pp 463–485).

It has now been found that a high performance variable conductance heat pipe may be made by constructing a transverse heat pipe that is provided with a baffle which causes vaporized liquid to flow in a longitudinal direction and liquid to flow in a transverse direction and a non-condensible gas that permits the operating surface area of the condenser region of the heat pipe to vary with the heat load.

Therefore, it is an object of this invention to provide a variable conductance heat pipe that has the capacity to handle higher heat loads.

It is also an object of this invention to provide a variable conductance heat pipe that is constructed without an artery and to thereby eliminate the priming problems, the bubbles and the depriming problems which are found in arterial wick heat pipes.

It is also an object of this invention to provide a variable conductance heat pipe having a more compact structure than prior art variable conductance heat pipes.

DESCRIPTION OF THE INVENTION

The transverse variable conductance heat pipe of this invention comprises a closed elongated casing having associated wicking means, a vaporizable liquid and a non-condensible gas therein. The interior of the casing is provided with a baffle means positioned therein to cause vaporized liquid to flow in a longitudinal direction. A reservoir for the non-condensible gas is provided which is in open communication with the casing.

The closed elongated casing may have a rectangular or annular cross-section. The wicking means within said casing may comprise a layer of stainless steel screen wire mesh placed around the interior wall of the casing.

The screen wire may be of a woven, knitted or perforated type of construction. Mesh sizes (U.S. Standard mesh) in the order of about 50 to about 350 mesh, preferably about 100 mesh may be employed depending on the particular vaporizable liquid. The screening may be made of stainless steel, aluminum, fiberglass or any metal alloy or stable material which is compatible with the selected vaporizable liquid. Also, it may comprise a series of grooves cut into the walls of the interior of the casing or a combination of both grooves and screen wire mesh. The particular wicking system may vary with the configuration of the casing.

The interior of the closed casing is provided with a vaporizable liquid and a non-condensible gas. Suitable vaporizable liquids include low boiling halogenated hydrocarbons, low boiling aromatic hydrocarbons, ammonia, acetone; halogenated hydrocarbons include dichloromonofluoromethane, dichlorodifluoromethane, monochlorodifluoromethane, carbontetrafluoride and the like.

The interior of the casing is provided with a baffle means that is positioned therein to cause vaporized liquid to initially flow in a longitudinal direction away from the end of the heat pipe where the reservoir for the non-condensible gas is placed. The baffle divides the vapor space in the transverse heat pipe and directs the flow of vaporized fluid longitudinally so that it passes to the condenser region of the heat pipe by a circuitous path. The baffle may be constructed in a generally flat perforate or imperforate fashion and is placed along the axis of the heat pipe with a vapor space opening at the opposite end of the heat pipe from the non-condensible gas reservoir.

The non-condensible gas may be any gas which is compatible with the selected vaporizable liquid and which does not liquefy under the operating conditions within the heat pipe. Suitable gases include inert gases such as nitrogen, argon, helium and mixtures thereof.

The transverse variable conductance heat pipe may be constructed with conduit means for transporting a material to be cooled, a closed elongated casing surrounding a part of the conduit means, said casing having walls that form a coaxial longitudinal enclosure around a part of said closed elongated casing. The closed elongated casing is provided with wicking means that extend radially from the conduit means to the interior walls. Optionally, the wicking may also surround the coaxially positioned conduit. A vaporizable liquid and a non-condensible gas are placed in the closed casing. A transverse baffle means is placed between the conduit means and the transverse walls of the closed elongated casing to cause vaporized liquid to flow in a longitudinal direction and a reservoir for the non-condensible gas is provided at one end of the casing. This reservoir is in open communication with the casing and allows the interface of the vaporized liquid and the non-condensible gas to move longitudinally and allows the heat pipe to perform under varying heat loads.

The conduit may be square, rectangular, annular, i.e., oval or round in cross section. The configuration is not critical and ease of fabrication will dictate the selection of a particular design although some configurations may have optimum performance characteristics. The elongated closed casing may also be square, rectangular, oval or round in cross section. A cylindrical configuration is preferred. The wicking may be made of wire mesh screening as noted above or it may be fabricated from other materials. The baffle is preferably fabricated as a cylinder with an opening at the end of the heat pipe opposite the non-condensible gas reservoir that provides for longitudinal flow of vaporized liquid from the evaporative surfaces of the conduit rather than radial flow directly to the condensing surface of the wicked interior wall of the casing. The baffle is provided with slots through which the radial wicking means pass to the conduit. This provides for liquid flow through the baffle means to the evaporative surface of the conduit.

DESCRIPTION OF THE PREFERRED EMBODIMENTS

Figure 1:
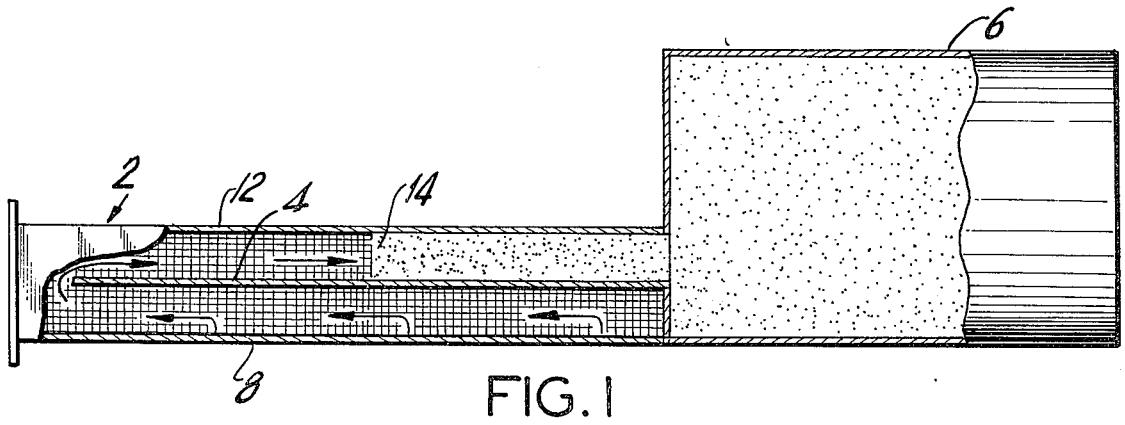
FIG. 1 is a partial cutaway view of a transverse heat pipe having an internal baffle at the midpoint of the rectangular cross section.

Referring to FIG. 1 of the drawings, there is shown a transverse variable conductance heat pipe according to the invention. The closed elongated casing 2 has a rectangular cross section and is provided with an internal baffle 4 at about the midpoint of the rectangular cross section. The casing is affixed to a non-condensible gas reservoir 6 which is filled with nitrogen. The lower portion 8 of the closed elongated casing is placed in a position where it absorbs heat from a heat source. The heat causes a vaporizable liquid, ammonia to vaporize and flow around baffle 4 to the upper portion 12 of the casing. The vapor condenses on the inside wall of upper portion 12, and heat, is passed through the wall to the outside. Condensed liquid returns to the lower portion by means of gravity or the wick. As the vaporizable liquid is vaporized, an interface zone 14 is formed between the vaporized ammonia and the nitrogen. This interface may move depending on the heat load that is imposed on the system. This feature imparts the variable heat transfer capability to the transverse heat pipe.

Figure 2:
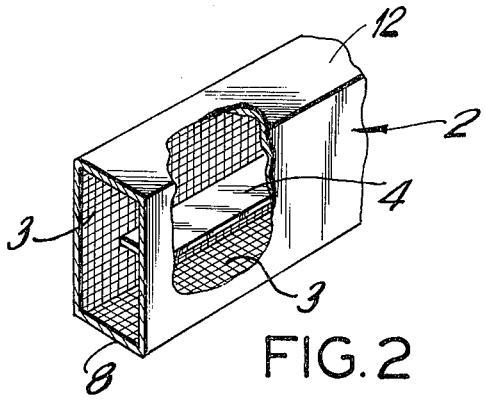
FIG. 2 is a partial cutaway cross section of FIG. 1.

FIG. 2 shows a cutaway section of the embodiment of FIG. 1. The screen mesh 3 is the wicking means for this type of heat pipe.

Figure 3:
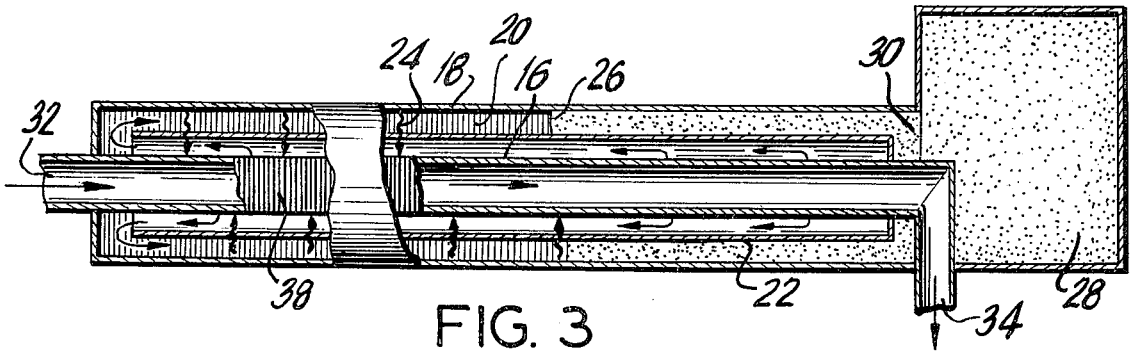
FIG. 3 is a partial cutaway cross section of a transverse heat pipe having a radially disposed internal baffle.

FIG. 3 shows an especially preferred embodiment of the invention wherein an annular conduit 16 is positioned coaxially within a cylindrical closed casing 18. This embodiment is provided with a grooved wall wicking 20 and with a baffle 22 through which passes a radial wicking 24. The vaporized liquid and non-condensible gas interface 26 moves in a longitudinal direction as the rate of heat input changes. The reservoir 28 for the non-condensible gas is shown to be in open communication with the closed casing by passageway 30.

The heated fluid is passed into the conduit at inlet 32 which is opposite from the end where the non-condensible gas reservior is located. The outlet 34 is located at the opposite end of the closed casing. The baffle 22 is positioned around conduit 16 so that vaporized liquid flows longitudinally to the inlet area of the heat pipe and not radially to the condenser area of the casing. The path of fluid flow may be reversed, if desired.

Figure 4:
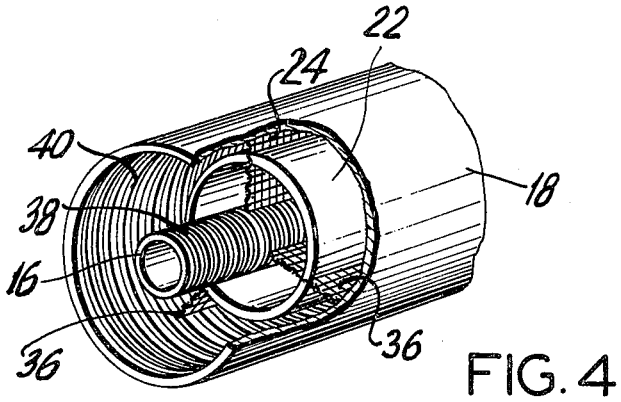
FIG. 4 is a partial cutaway cross section of FIG. 3.

FIG. 4, a cross section of FIG. 3 shows in partial cutaway, the interior construction of a coaxial transverse variable heat pipe. Radial wicking 24 is shown extending from a grooved wicked conduit 38 to the grooved wicked interior wall 40 of the casing. The embodiment of FIG. 4 has three radial wicks made of screen wire mesh. Optionally, it is possible to use more or less radial wicks depending on the particular application.

Obviously, other modifications and variations of the present invention are possible in the light of the above teachings. It is, therefore, to be understood that changes may be made in the particular embodiments of the invention described which are within the full intended scope of the invention as defined by the appended claims.

I claim:

1. A transverse variable conductance heat pipe which comprises a closed elongated casing having wicking means on the interior walls, a vaporizable liquid and a non-condensible gas therein; said closed elongated casing having transverse baffle means positioned therein to cause vaporized liquid to flow in a longitudinal direction; a reservoir for said non-condensible gas, said reservoir being in open communication with said closed elongated casing and means at the opposite end of the heat pipe from the reservoir to communicate the reservoir with the condenser region of the heat pipe.

2. The transverse variable conductance heat pipe of claim 1 wherein the closed elongated casing has a rectangular cross section.

3. The transverse variable conductance heat pipe of claim 1 wherein the closed elongated casing has an annular cross section.

4. The transverse variable conductance heat pipe of claim 1 wherein the wicking means is a layer of a screen mesh that extends around the interior of the closed elongated casing.

5. The transverse variable conductance heat pipe of claim 4 wherein the vaporizable liquid is selected from the group consisting of low boiling halogenated hydrocarbons, low boiling aromatic hydrocarbons, ammonia and acetone.

6. The transverse variable conductance heat pipe of claim 4 wherein the non-condensible gas is selected from the group consisting of nitrogen, helium, argon and mixtures thereof.

7. The transverse variable conductance heat pipe of claim 1 wherein the wicking means are a plurality of grooves on the interior of the closed elongated casing.

8. A transverse variable conductance heat pipe which comprises conduit means for transporting a material to be cooled, a closed elongated casing surrounding a part of said conduit means, said closed elongated casing having walls that form a coaxial longitudinal enclosure around a part of said conduit means, said closed elongated casing having wicking means around the interior walls and extending radially from said conduit means to said interior walls; said closed elongated casing having a vaporizable liquid and a non-condensible gas therein, and having transverse baffle means positioned in said closed elongated casing to cause vaporized liquid to flow in a longitudinal direction; a reservoir for said non-condensible gas, said reservoir being in open communication with said closed elongated casing and means at the opposite end of the heat pipe from the reservoir to communicate the reservoir with the condenser region of the heat pipe.

9. The transverse variable conductance heat pipe of claim 8 wherein said conduit means is an annular tube.

10. The transverse variable conductance heat pipe of claim 8 wherein said closed elongated casing is cylindrical.

11. The transverse variable conductance heat pipe of claim 8 wherein the vaporizable liquid is selected from the group consisting of low boiling halogenated hydrocarbons, low boiling aromatic hydrocarbons, ammonia and acetone.

12. The transverse variable conductance heat pipe of claim 8 wherein the non-condensible gas is selected from the group consisting of nitrogen, helium, argon and mixtures thereof.

* * * * *